US006570962B1

(12) United States Patent
Maska et al.

(10) Patent No.: US 6,570,962 B1
(45) Date of Patent: May 27, 2003

(54) X-RAY TUBE ENVELOPE WITH INTEGRAL CORONA SHIELD

(75) Inventors: Mark S. Maska, Palatine, IL (US); Jason P. Harris, Aurora, IL (US); Todd R. Bittner, Chicago, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/060,421

(22) Filed: Jan. 30, 2002

(51) Int. Cl.[7] ..... H01J 35/10
(52) U.S. Cl. ..... 378/140; 378/121; 378/203
(58) Field of Search ..... 378/119, 121, 378/140, 203; 313/313; 174/35 MS, 35 TS

(56) References Cited

U.S. PATENT DOCUMENTS 5,136,625 A * 8/1992 Heiting et al. ..... 378/139
5,506,881 A 4/1996 Ono et al. ..... 378/125

* cited by examiner

*Primary Examiner*—Drew A. Dunn
*Assistant Examiner*—Courtney Thomas
(74) *Attorney, Agent, or Firm*—Eugene E. Clair

(57) ABSTRACT

An x-ray tube comprising a first electrode and a second electrode. The first and second electrodes are located in operative relationship with one another to generate x-rays when the electrodes are energized at their respective operating potential. An evacuated envelope encloses the first and second electrodes. The evacuated envelope includes a first envelope wall portion, a second envelope wall portion and an envelope weld member comprising an electrical conductor. The envelope weld member is in electrical communication so as to be at operating potential of one of the first and second electrodes when the x-ray tube is energized. The envelope weld member is adapted for vacuum tight joining to the first envelope wall portion and to the second envelope wall portion. The envelope weld member has an integral corona shield portion.

16 Claims, 13 Drawing Sheets

X-RAY TUBE ENVELOPE WITH INTEGRAL CORONA SHIELD

BACKGROUND

The present invention relates to an x-ray tube and is particularly related to an apparatus for reducing the likelihood of electrical discharge between an x-ray tube envelope and an x-ray tube housing. Principles of the present invention find particular application in a corona shield integrally formed with weld members that join segments of the x-ray tube envelope. Features and principles of the present invention will be described with particular respect thereto.

Typically, a rotating anode x-ray tube includes an evacuated envelope comprised of glass which encloses a cathode assembly, a rotating anode assembly and a bearing assembly to facilitate anode rotation. An induction motor is provided to drive rotation of the anode. The induction motor includes a stator located external the evacuated envelope and a rotor attached to the anode assembly located within the envelope. Energizing the stator coils causes the rotor of the induction motor to rotate the anode in the bearing assembly.

Some higher power x-ray tubes, such as those used in Computed Tomography applications, have different portions of the evacuated envelope made of materials other than glass or in combination with glass. In some of these multiple material envelope x-ray tubes, the central portion of the envelope surrounding a rotating anode target is comprised of metal. The cathode end and anode end of the evacuated envelope is comprised of an insulator material such as a ceramic or glass.

Another common construction of multiple material x-ray tube envelopes is a single insulator portion joined with the metal envelope portion. The metal portion of the envelope extends from the tube center to one end of the x-ray tube. In this configuration the other end of the x-ray tube is enclosed by the insulator portion. For example, the metal envelope extends from the center of the tube to the anode end of the tube and the insulator portion surrounds the cathode end of the x-ray tube. In this configuration, the anode can be kept at the same potential as the surrounding metal portion of the evacuated envelope.

The x-ray tube and induction motor is enclosed in a housing assembly which is used to mount the x-ray tube in an imaging system as well as provide for cooling and electrical connections for operation of the x-ray tube. The housing contains a fluid, such as a dielectric electrical insulating oil having high electrical resistance, to provide electrical insulation for the high voltage connections. The high-dielectric strength oil is a very effective insulating medium for filling interstitial spaces between the components of the x-ray tube system as well as impregnating any porous and permeable materials within the components. In addition, the fluid is circulated through the housing and an associated cooling system to provide cooling for the x-ray tube. The x-ray tube housing is usually at ground potential.

During production of x-rays a current is passed through a cathode filament located in the cathode assembly. This current heats the cathode filament such that a cloud of electrons is emitted, i.e. thermionic emission occurs. A high electrical potential, on the order of 75–200 kV, is applied across the cathode assembly and the anode assembly. The high voltage potential accelerates the thermionically emitted electrons and causes them to flow in an electron beam from the cathode assembly to the anode assembly. A cathode cup focuses the flowing electrons onto a small area, or focal spot, on a target of the anode assembly thereby generating x-rays. A portion of the generated x-rays pass through x-ray transmissive windows of the envelope and the x-ray tube housing.

Substantial heat is produced by the electron beam striking the anode during the generation of x-rays. The electrical insulating oil within the housing and surrounding the x-ray tube removes heat produced during the generation of x-rays. The properties, and useful life expectancy, of electrical insulating oils is affected by operating conditions of the x-ray tube.

Electrical insulating oils are typically characterized by two properties: Corona Inception Voltage (CIV) and dielectric strength. Corona is a luminous discharge attributed to ionization of the media surrounding a conductor or tube component having a high voltage. Corona can reduce the dielectric life time and ultimately cause dielectric failure of the insulating oil. High current densities associated with corona result in gasification of the dielectric medium, which in turn decreases the voltage level at which corona or ionization damage begins to occur; e.g., the CIV. Above the CIV, corona is intensified and a decrease in the insulating properties and useful life of the dielectric medium is seen. Below the CIV, corona still occurs, but at a much reduced level. In addition, corona in power components or systems increases exponentially as dielectric strength decreases. At some point, dielectric breakdown, an electrical short circuit through the oil, occurs as a result of corona.

Most of the corona by-products are gases that follow the laws of solution. The gasses form bubbles and reabsorb depending on the temperature and pressure under which the insulating oil is used. When the solution is near saturation, the gaseous contaminates are easily ionized by an electric field. Consequently, corona activity in electrically stressed oil increases over time. As the levels of the ionization products increase in the oil, the likelihood of arcing and tube failure can increase.

Both the CIV and the dielectric strength are significantly reduced by the presence of any contamination in the oil. Contamination, whether it be gaseous, moisture, or particulate, increases as oil ages, directly causes degradation of the insulating system, and ultimately can cause arcing as well as system or component failure. Several mechanisms, including corona, oxidation, heat, electrical stress, and moisture, are known causes of oil degradation and contamination build-up. Electrically stressing a component or system will cause corona or ionization of the insulating oil to occur.

In addition to breakdown in the oil resulting in greater likelihood of corona discharge and arcing, the shapes of surfaces of the x-ray tube envelope components can affect corona production and arcing. In the higher power multi material envelope x-ray tubes, the various metal and insulator evacuated envelope components have attached weld flanges made of electrically conductive metal. The weld flanges typically join the insulator portion and metal section of the envelope such that long thin sections of metal extend around the envelope and away from the tube envelope. The weld flanges are used to join adjacent envelope sections. The joined weld flanges result in surfaces that have abrupt edges. The edges result in a non-uniform electric field having irregular and substantially higher local electric field strength at the edge. These non-uniform higher electric field irregularities result greater likelihood of corona discharge, oil breakdown and arcing between the tube envelope and housing.

In addition, as an x-ray tube experiences normal operation in the field, the cooling fluid in the housing surrounding the envelope is exposed to high temperatures which breaks down the oil. When this heat related break down of the oil occurs, the dielectric properties of the oil are also adversely affected. This results in reduced dielectric strength of the electrically insulating oil and less electrical insulation between the high voltage components of the x-ray tube as well as the housing.

An arc is an undesired surge of electrical current between two elements of the x-ray tube system which are at a different electrical potential. In x-ray tubes, this tendency to arc often increases as the tube ages due to factors such as degradation of dielectric electrical insulating and cooling fluid within the housing surrounding the evacuated envelope. As the electrical insulating properties of the fluid decreases, the likelihood of arcing between the housing and the x-ray tube increases.

Arcing in an x-ray tube used in a Computed Tomography (CT) imaging system can contaminate the signal collected at the detectors and affects proper image reconstruction. This may result in an un-usable set of data requiring another CT scan of the patient.

Arcing typically occurs in the area of the x-ray tube having the highest electric field strength. As such, arcing in an x-ray tube may commonly occur at components or component interfaces which form edges or other structural features that cause increased localized electric field stresses when the component is at a high electric potential during x-ray tube operation.

SUMMARY OF THE INVENTION

The present invention is directed to an evacuated envelope weld member that satisfies the need to provide a junction between evacuated envelope components at high voltage x-ray tube operating potential which reduces corona discharge, arcing and breakdown of electrical insulating oil in x-ray tube systems. An apparatus in accordance with one embodiment of the present invention includes an x-ray tube comprising a first electrode and a second electrode. The first and second electrodes are located in operative relationship with one another to generate x-rays when the electrodes are energized at their respective operating potential. An evacuated envelope encloses the first and second electrodes. The evacuated envelope includes a first envelope wall portion, a second envelope wall portion and an envelope weld member comprising an electrical conductor. The envelope weld member is in electrical communication so as to be at operating potential of one of the first and second electrodes when the x-ray tube is energized. The envelope weld member is adapted for vacuum tight joining to the first envelope wall portion and to the second envelope wall portion. The envelope weld member has an integral corona shield portion.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of embodiments that apply principles of the present invention with reference to the accompanying drawings, wherein.

DETAILED DESCRIPTION

Figure 1:
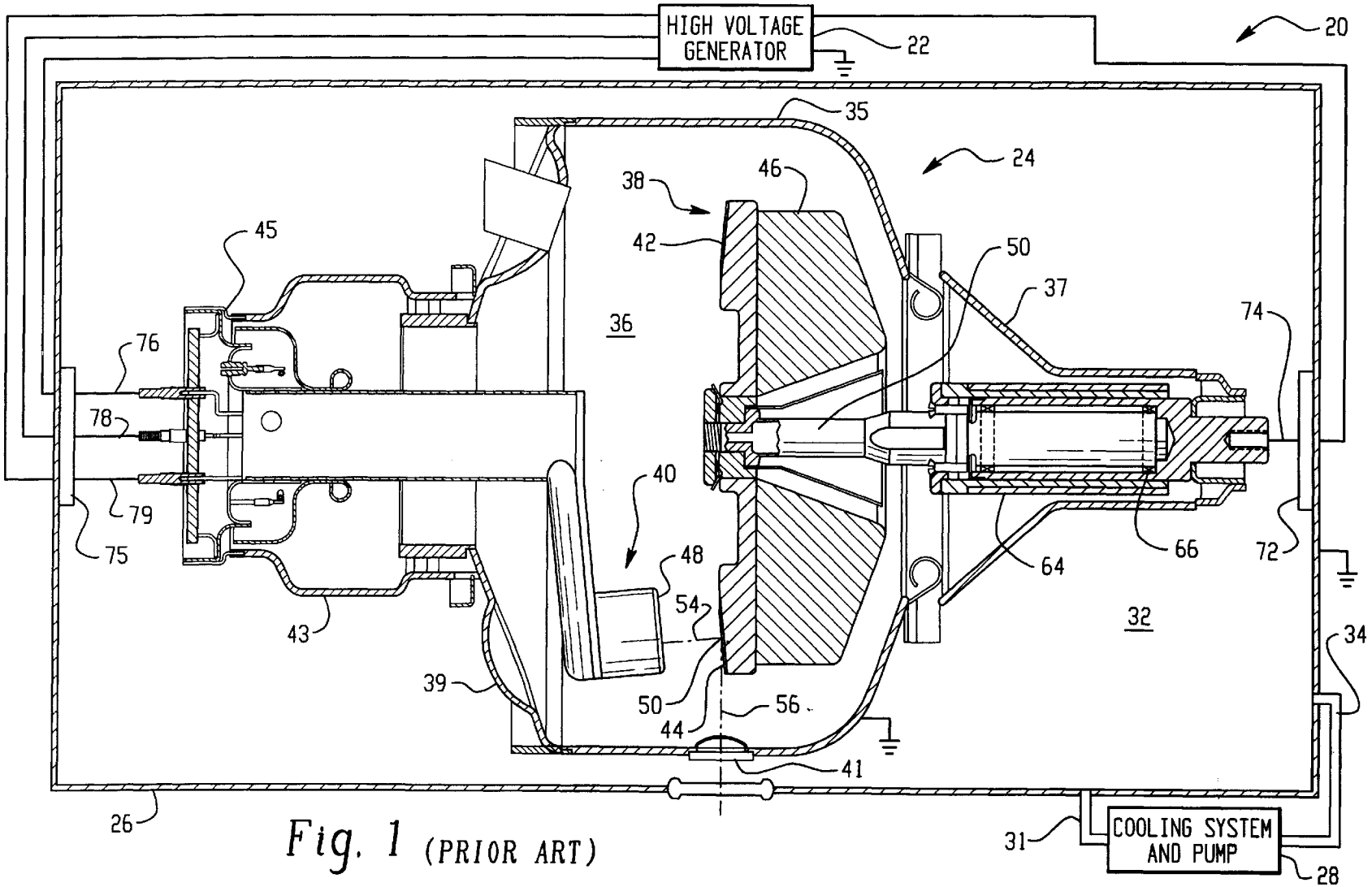
Fig. 1 (PRIOR ART)
FIG. 1 is a sectional schematic representation of a prior art x-ray tube system.

With reference to FIG. 1, a prior art x-ray tube system 20 is shown. The system 20 includes a high voltage power supply 22, an x-ray tube 24 mounted within a housing 26 and a heat exchanger 28. The x-ray tube 24, also commonly referred to as an insert, is securely mounted with tube supports (not shown) in a conventional manner within the x-ray tube housing 26. The housing 26 is filled with a cooling fluid, for example a dielectric electrical insulating oil, having high electrical resistance. However, it will be appreciated that other suitable insulating and cooling fluid/medium could alternatively be used. The oil is pumped through a supply line 31 into a chamber 32, defined by the x-ray tube housing 26, which surrounds the x-ray tube 24. The pumped oil absorbs heat from the x-ray tube 24 and exits the housing 26 through a return line 34 connected to the heat exchanger 28 disposed outside the x-ray tube housing 26. The heat exchanger 28 includes cooling fluid pump (not shown).

The x-ray tube 24 includes an evacuated envelope 35 defining an evacuated chamber 36. In some higher power x-ray tubes, the envelope 35 can be made of glass in combination with other suitable materials including ceramics and metals. For example, an anode wall portion 37 is comprised of metal, such as copper or other suitable metal. The center wall portion 39 is also comprised of a suitable metal and has an x-ray transmissive window 41. Alternatively, the center wall portion 39 may be metal and the anode wall portion may be ceramic or glass. A cathode wall portion 43 is comprised of glass or other suitable ceramic material.

Disposed within the envelope 35 is an anode assembly 38 and a cathode assembly 40. The anode assembly 38 includes a circular target substrate 42 having a focal track 44 along a peripheral edge of the target 42. The focal track 44 is comprised of a tungsten alloy or other suitable material capable of producing x-rays when bombarded with electrons. The anode assembly 38 further includes a back plate 46 made of graphite to aid in cooling the target 42.

The anode assembly 38 includes a bearing assembly 66 for rotatably supporting the target 42. The target 42 is mounted to a rotor stem 58 in a manner known in the art. The rotor stem 58 is connected to a rotor body 64 which is rotated during operation about an axis of rotation by an electrical stator (not shown). The rotor body 64 houses the bearing assembly 66 which provides support thereto.

The cathode assembly 40 is stationary in nature and includes a cathode focusing cup 48 operatively positioned in a spaced relationship with respect to the focal track 44 for focusing electrons to a focal spot 50 on the focal track 44. A cathode filament (not shown) mounted to the cathode focusing cup 48 is energized to emit electrons 54 which are accelerated to the focal spot 50 to produce x-rays 56.

The power supply 22 provides high voltage of 70 kV to 100 kV to the anode assembly 38 through an anode socket 72 and conductor 74 located within the cooling fluid filled housing 26. The socket 72 and conductor 74 are suitable for providing electrical connections for the operating voltage of the anode.

The cathode assembly 40 is suitably connected to the power supply 22 with a cathode socket 75 and conductors 76, 78, 79, to provide necessary operating power to the cathode assembly 40 for the x-ray tube, typically −70 kV to −100 kv. Alternatively, the anode end may be held at ground or common potential and a suitable high voltage applied to only the cathode components for proper x-ray tube operation.

Figure 2:
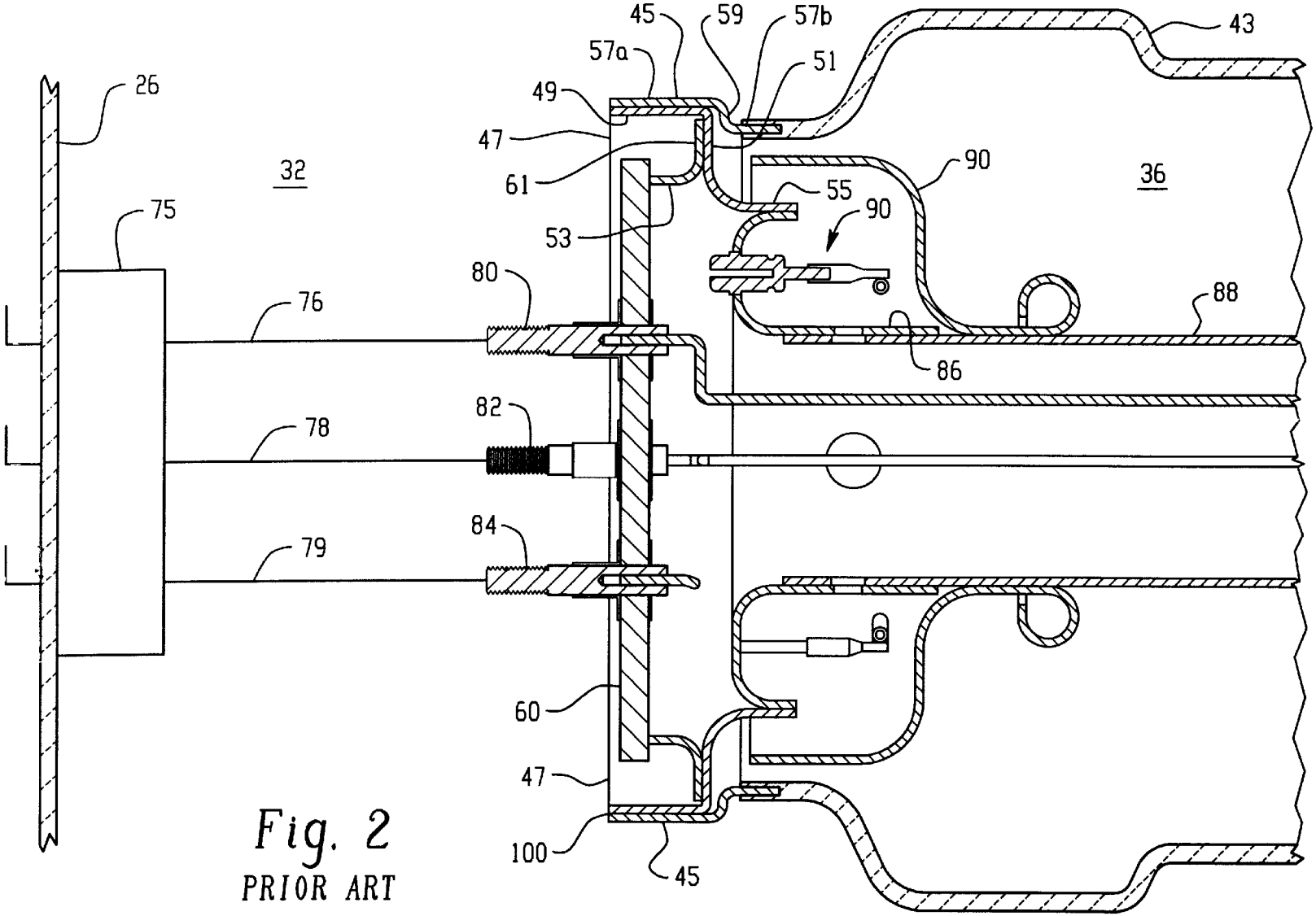
Fig. 2 PRIOR ART
FIG. 2 is a partial sectional representation of a cathode end of a prior art x-ray tube in the system of FIG. 1.

Turning now to FIG. 2, components comprising portions of the cathode end of a prior art x-ray tube are shown in greater detail. A cathode ring 45 has two generally cylindrical end portions 57*a*, 57*b*, each end portion having a different diameter, that are interconnected with a curved transition portion 59. The glass cathode wall portion 43 is suitably joined using known methods to the end portion 57*b* of the cathode ring 45. The cathode ring 45 is comprised of metal and forms a vacuum tight seal at the end of the cathode wall portion 43.

A metal cathode weld ring 47 has an extension 49 at one end that is a generally cylindrical wall having a central axis. One end of the extension 49 bends through a suitable angle into an annular portion 51 which extends toward the central axis of the cylindrical extension 49. The most central portion of the annular portion 51 transitions through a bend into a getter baffle 55. The getter baffle 55 is a generally cylindrical wall with its central axis lying along the central axis of the cathode weld ring 47. The diameter of the getter baffle 55 is less than the diameter of the cathode weld ring 47. The distance that the annular portion 51 extends between the extension 49 and getter baffle 55 is sufficient to provide a surface for brazing or welding to a base ring weld flange 53 as further described below. The cylindrical extension 49 of the cathode weld ring 47 is received within, and extends along, the inner cylindrical surface of the end 57*a* of the cathode ring 45. The cathode ring 45 and cathode weld ring 47 are joined vacuum tight with a weld.

A disk shaped ceramic cathode base plate 60 is brazed in a vacuum tight manner to one end of the base ring weld flange 53. The base ring weld flange 53 is generally cylindrical at the end that is brazed to the base plate 60. The other end of the base ring weld flange transitions through a bend to form an annular surface 61 with its outer perimeter having a diameter greater than the cylindrical end which is attached to the base plate 60. The surface area of the annular surface 61 is sufficient to braze the base ring weld flange 53 in a vacuum tight manner to the annular portion 51 of the cathode weld ring 47. Cathode terminals 80, 82, 84 extend through the base plate 60 and are brazed vacuum tight. The terminals 80, 82, 84 provide electrical operating connections for the cathode assembly 40.

A getter plate 86 has a generally "J" shaped annular channel, the shorter flange of its "J" channel welded to the getter baffle 55 of the cathode weld ring 47. The longer flange of the "J" channel is welded to a tubular cathode arm support 88. A getter assembly 90 is mounted in the trough of the "J" channel. A getter shield 90 is an annular bell shaped member which overlaps the getter plate 86 in a manner known in the art. The getter shield 90 is welded to the cathode arm support 88.

After final assembly of the x-ray tube, at least the following structures shown in FIG. 2 have the same electrical potential as the cathode: the cathode arm support 88; the getter shield 90; the getter plate 86; at least one of the terminals 80, 82, 84; the cathode weld ring 47; the base ring weld flange 53; and the cathode ring 45. During operation the electric potential of the cathode may be −70 kV or other suitable known operating electrical potential. The joined flanges of the cathode ring 45 and the cathode weld ring 47 result in a thin annular cathode weld flange interface 100 which circumscribes the cathode base plate 60. When this interface 100 is at operating potential of −70 kV the abrupt edges at the interface 100 are electric field stress risers which contribute to corona discharge and electrical arcing within the x-ray tube system as well as other problems described above.

Figure 3:
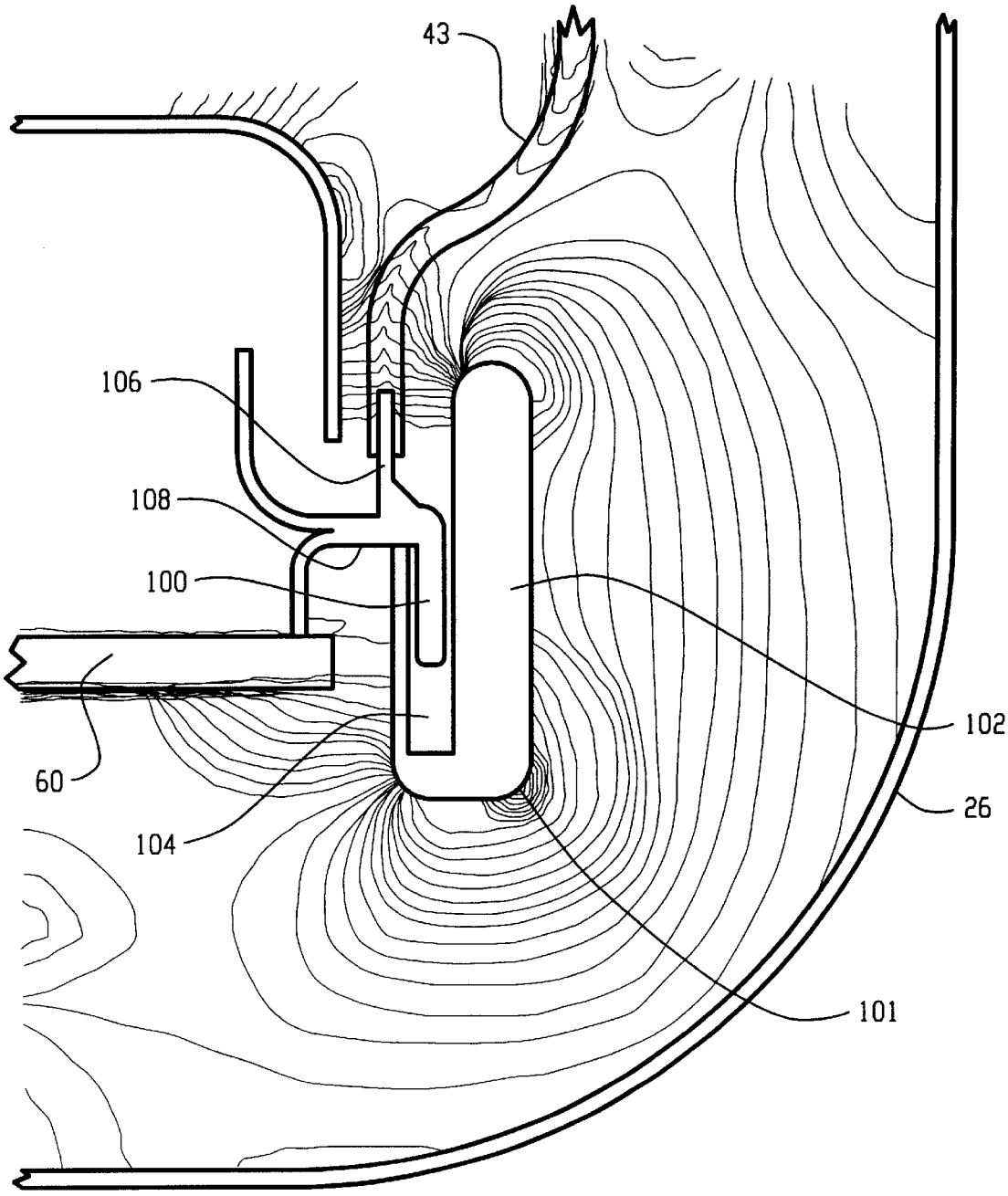
Fig. 3 PRIOR ART
FIG. 3 shows a plot for electric field strength at operating electrical potential for a partial sectional representation of a prior art corona shield assembly in electrical contact with a cathode ring.

Turning now to FIG. 3, a prior art press on discrete corona shield 102 is shown. The prior art corona shield 102 is generally ring shaped with an annular recess 104 that receives the weld flange interface 100 of a cathode ring 106 and a cathode weld ring 108. In this figure, the corona shield is shown in good electrical contact with the cathode weld ring 108. FIG. 3 also shows a plot for electric field strength at operating electrical potential for a partial sectional representation of the prior art corona shield assembly in good electrical contact with the cathode ring 106. At cathode operating potential of approximately −70 kV, the highest electric field strength at the surface of the discrete corona shield is approximately $1.06\times10^7$ V/m at location 101. The electric field strength decreases as a function of distance away from the corona shield 102 toward the housing 26. The decrease in electric field strength is not uniform along the surface of the corona shield 102 nor does it decrease uniformly between the corona shield 102 and the housing 26. In addition, the area of highest electric field is concentrated along a small portion of the surface of the corona shield. This localized higher electric field strength results in increased corona discharge and other problems as described above.

Figure 4:
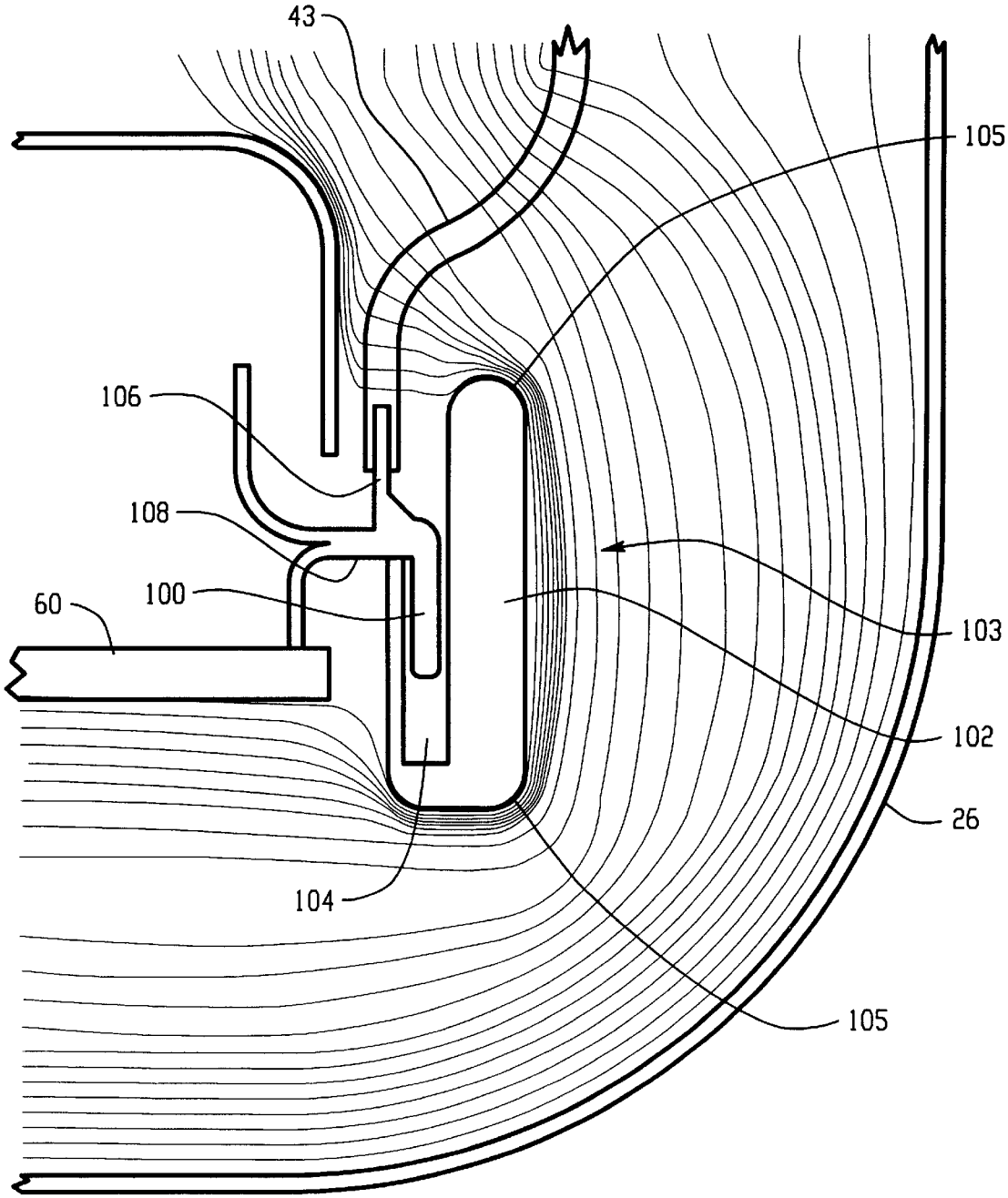
Fig. 4 PRIOR ART
FIG. 4 shows a plot of equipotential lines at operating electrical potential between the prior art corona shield of FIG. 3 and a housing.

FIG. 4 shows a plot of equipotential lines for the prior art discrete corona shield 102 of FIG. 3 with the corona shield 102 at cathode operating electrical potential and the housing 26 at ground potential. As shown in FIG. 4, the contour of the prior art corona shield is not generally similar to the shape or contour of the equipotential lines between the shield 102 and housing 26. For example, the distances between equipotential lines is generally greater in the central region shown by 103 than at the corner regions shown by 105. In addition, the contour of the equipotential lines nearest to the shield do not have a contour the same as or similar to the equipotential lines near the housing. The electric field strength and equipotential profiles are generated using commercially available software and computer drafting or design packages.

Figure 5:
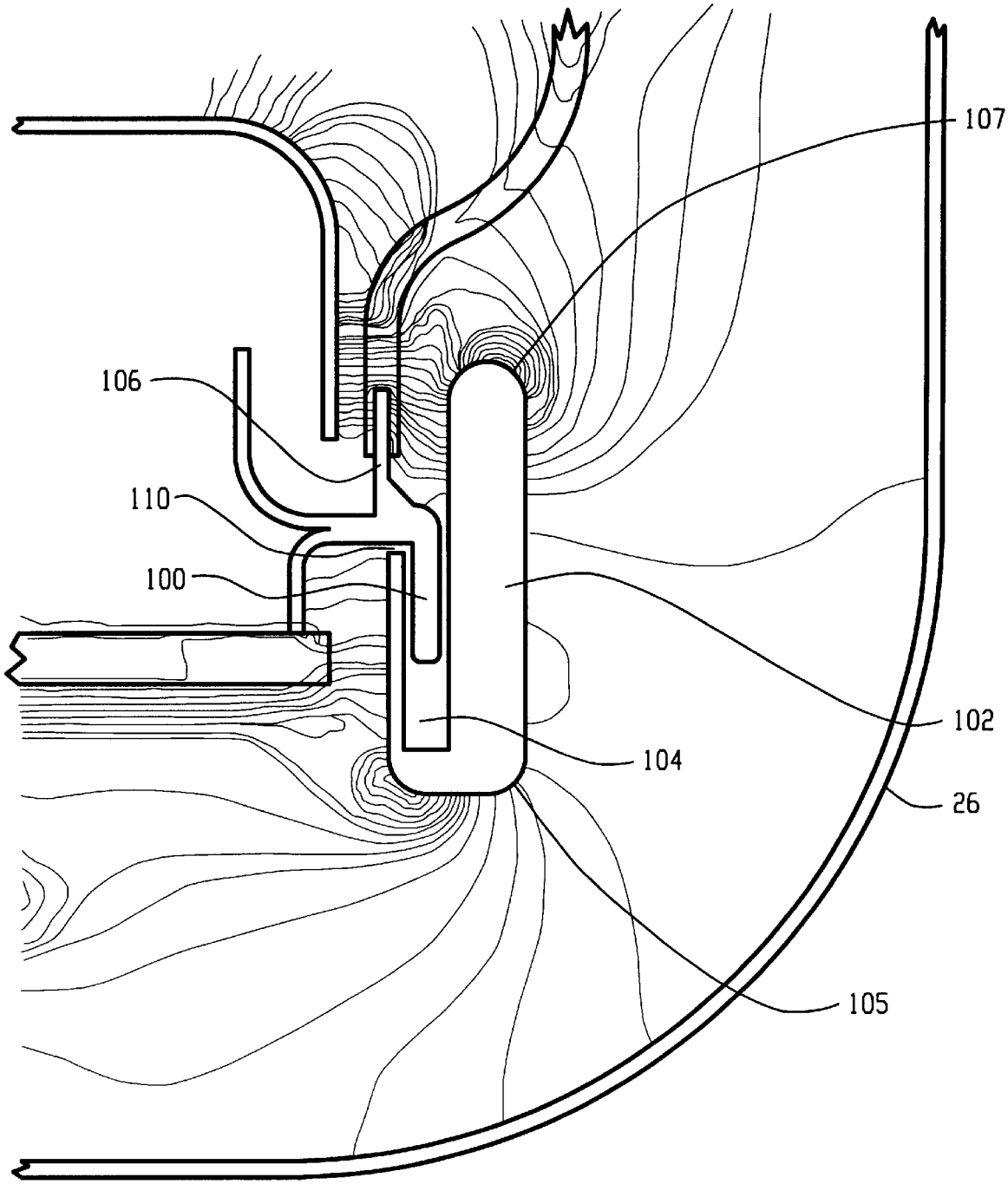
Fig. 5 PRIOR ART
FIG. 5 shows a plot for electric field strength at operating electrical potential for a partial sectional representation of a prior art corona shield assembly in poor electrical contact (electrically floating) with a cathode ring.
Figure 6:
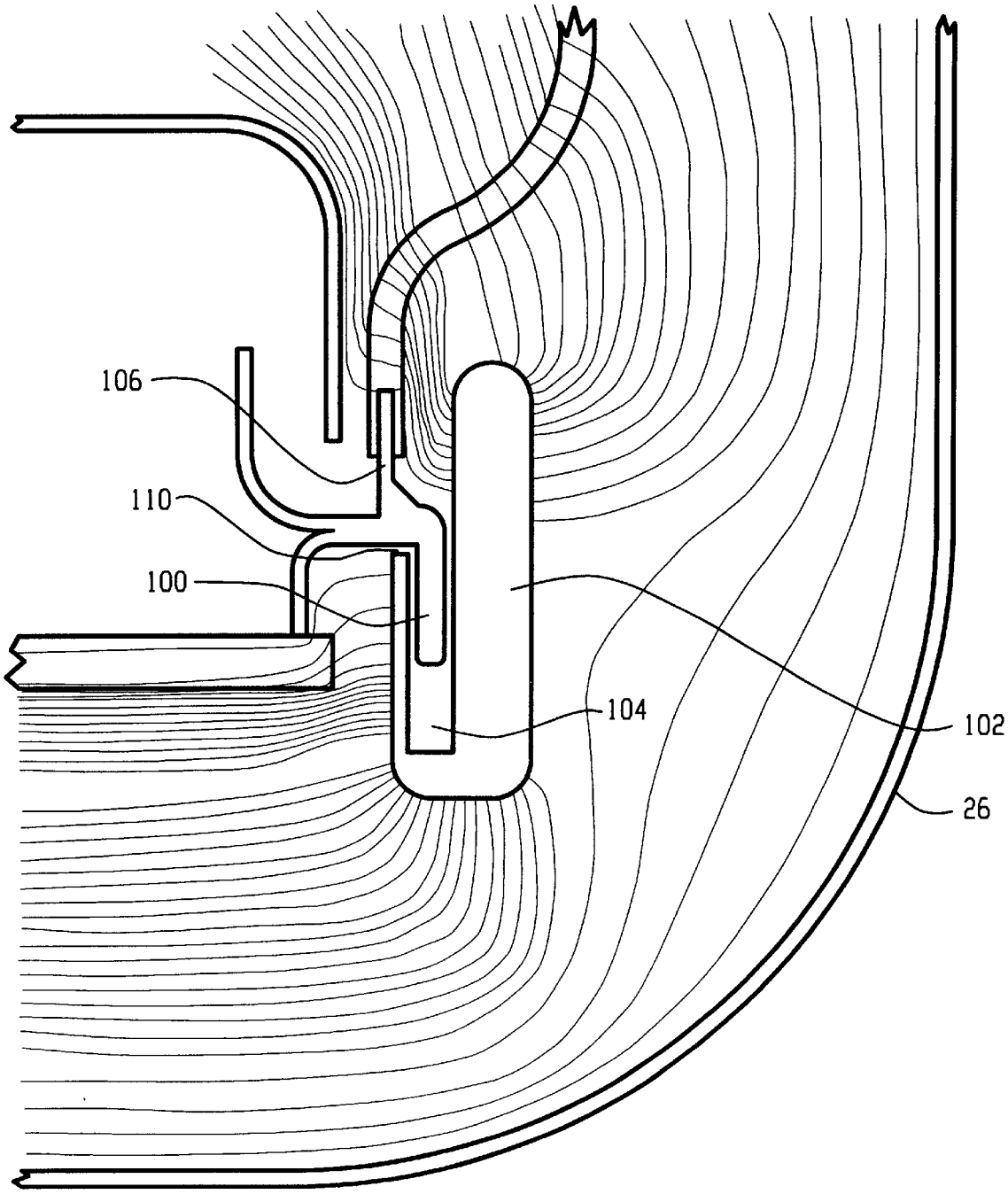
Fig. 6 PRIOR ART
FIG. 6 shows a plot of equipotential lines at operating electrical potential between the prior art corona shield of FIG. 5 and a housing.

FIGS. 5 and 6, show the prior art press on corona shield 102 of FIGS. 3 and 4, however, the shield is not in good mechanical and/or electrical contact with the interface 100, as shown by the gap 110. Poor mechanical and electrical connection, as well as immersion of the x-ray tube in electrically insulating oil as described above, can affect the electrical connection between the prior art discrete corona shield 102 and the weld interface 100. As such, the poorly connected press on corona shield can float electrically and charge to an unknown electrical potential. FIG. 5 shows a plot for electric field strength for the poorly connected prior art cathode shield 102 with the highest electric field strength approximately $1.63\times10^7$ V/m at location 107. The decreasing field strength along the surface of the shield and between the shield and the housing is not uniform. In addition, the area of highest electric field is concentrated along a small portion of the surface of the corona shield, thereby resulting in relatively higher localized electric field strength and increased corona discharge.

Turning briefly to FIG. 6, equipotential lines with the x-ray tube at operating electrical potential are shown for the poorly connected prior art shield of FIG. 5. The equipotential lines between the corona shield and the housing do not follow the contour of the shape of the corona shield.

Figure 7:
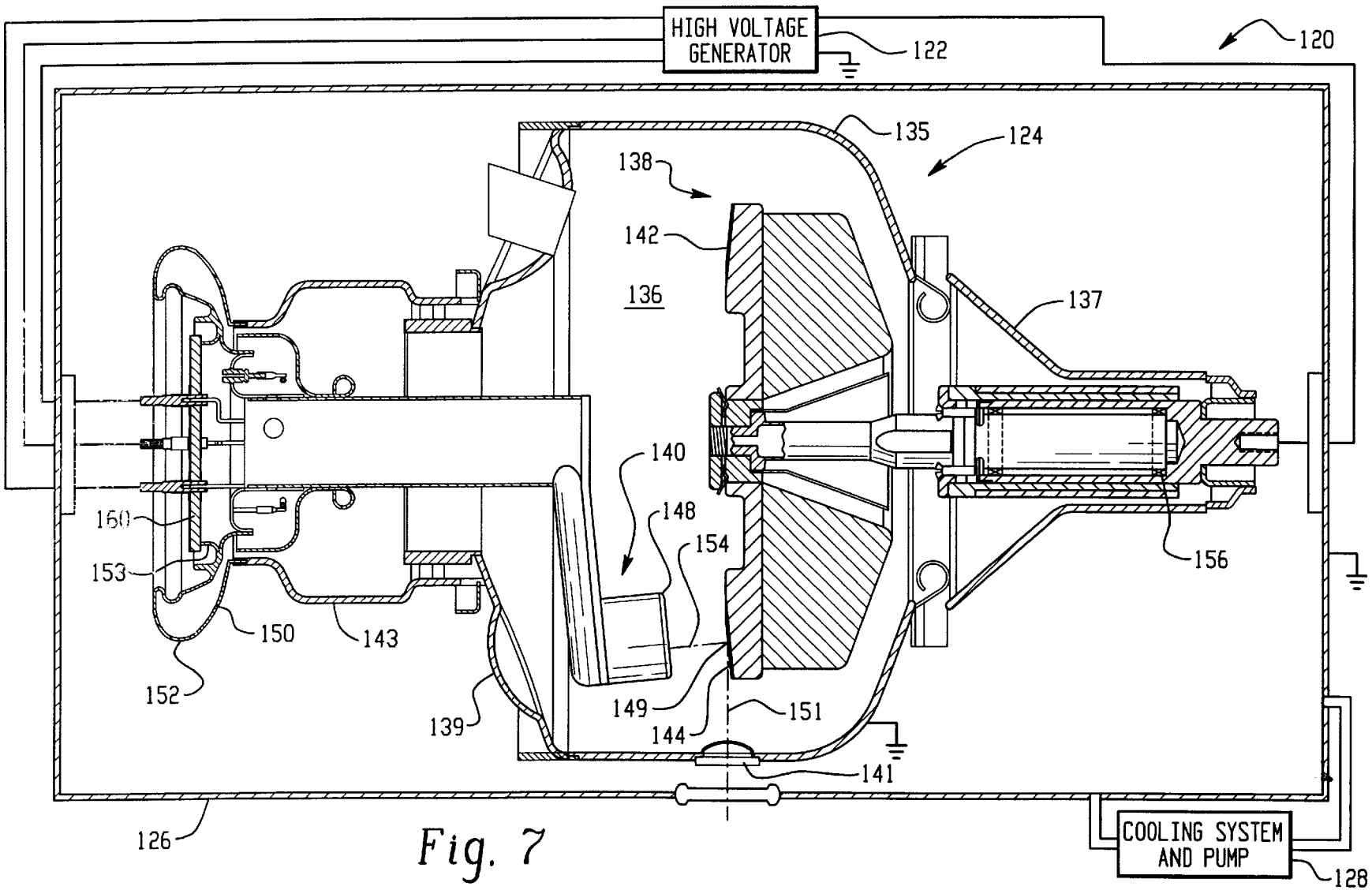
FIG. 7 is a sectional schematic representation of an x-ray tube system including an evacuated envelope weld member having an integral corona shield illustrating principles of the present invention.

FIG. 7 shows an x-ray tube system 120 which illustrates principles of the present invention. The x-ray tube system 120 includes a high voltage power supply 122, an x-ray tube 124 mounted within a housing 126 and a heat exchanger 128 suitably in fluid communication with the system to provide cooling for the electrical insulating oil as described above.

The x-ray tube 124 includes an evacuated envelope 135 defining an evacuated chamber 136. In higher power x-ray tubes, the envelope 135 is made of glass in combination with other suitable materials including ceramics and metals. For example, an anode wall portion 137 is comprised of metal, such as copper or other suitable metal. The center wall portion 139 is also comprised of a suitable metal and has an x-ray transmissive window 141. Alternatively, the center wall portion 139 may be metal and the anode wall portion 137 may be ceramic or glass. A cathode wall portion 143 is comprised of glass or other suitable ceramic material. The cathode wall portion 143 is vacuum tight joined in a known manner to one end of an envelope weld member 150. The weld member 150 is comprised of metal and includes an integral corona shield 152. The weld member 150 including the integral corona shield 152 can be fabricated by spinning, extrusion, stamping or other suitable forming or machining process. The other end of the envelope weld member 150 is brazed in a vacuum tight manner to a base ring weld flange 153 which is brazed to a ceramic cathode base plate 160.

Disposed within the envelope 135 is an anode assembly 138 and a cathode assembly 140. The anode assembly 138 includes a circular target substrate 142 having a focal track 144 comprised of a tungsten alloy or other suitable material capable of producing x-rays when bombarded with electrons. The anode assembly 138 includes a bearing assembly 156 for rotatably supporting the target 142.

The cathode assembly 140 is stationary in nature and includes a cathode focusing cup 148 operatively positioned in a spaced relationship with a focal spot 149 on the focal track 144. A cathode filament (not shown) mounted to the cathode focusing cup 148 is energized to emit electrons 154 which are accelerated to the focal spot 149 to produce x-rays 151. The power supply 122 provides suitable operating voltage to the anode assembly 138 and the cathode assembly 140.

Figure 8:
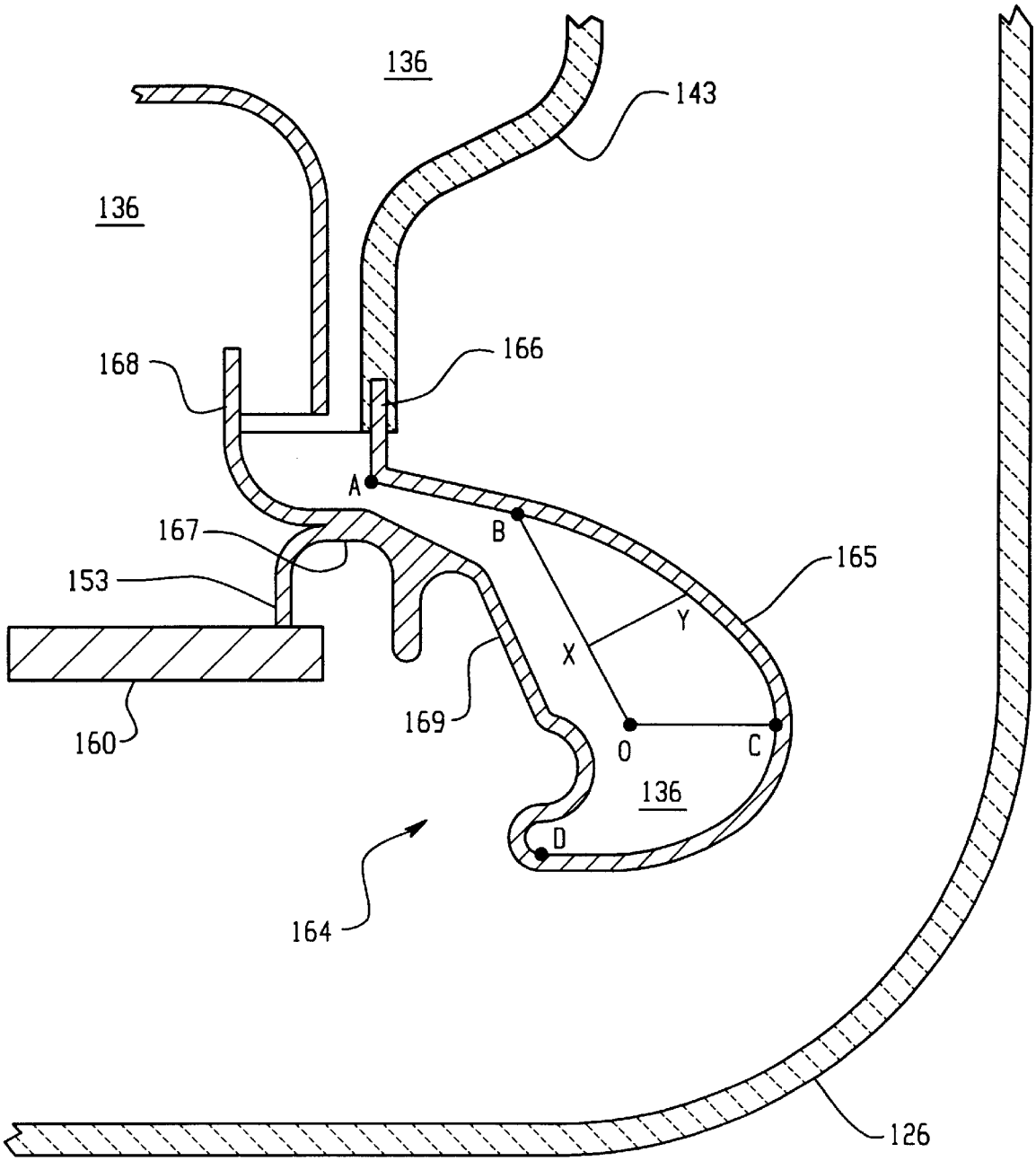
FIG. 8 shows a partial sectional representation of a weld member having an integral corona shield according to principles of the present invention.

Turning to FIG.8, one embodiment is shown of a weld member 164 having an integral corona shield 165 that applies principles of the present invention. The weld member 164 has a flange 166 that is joined in a known manner to the glass cathode wall portion 143. The integral corona shield 165 includes a curved structure that is shaped as a figure of revolution. At one end of the shield a flat portion extends angularly from the flange 166 from point A to point B. The initial portion of the figure of revolution is a sinusoidal curved portion extending from point B to point C. The sinusoidal portion from B to C can be defined by $XY=OC\ \sin(\pi/2\times BX/BO)$. The sinusoidal curve portion transitions to a circular section extending from C to D. The arc of the circular section CD is centered at O and has radius OC. The combination of curved portions of the figure of revolution is an empirically derived Bruce profile electrode shape which results in a relatively uniform distribution of electric field strength along the integral corona shield 165. As seen in FIG. 8, the integral corona shield 165 forms part of the wall of the evacuated envelope 135 enclosing the evacuated chamber 136. A connecting wall 169, which may be a flat configuration or also include curved segments as shown in FIG. 8, extends from Point D to a flange 167. The flange 167 is brazed to the base ring weld flange 153 which is joined to the cathode base plate 160. Optionally, the flange 167 extends to include a getter baffle 168.

Figure 9:
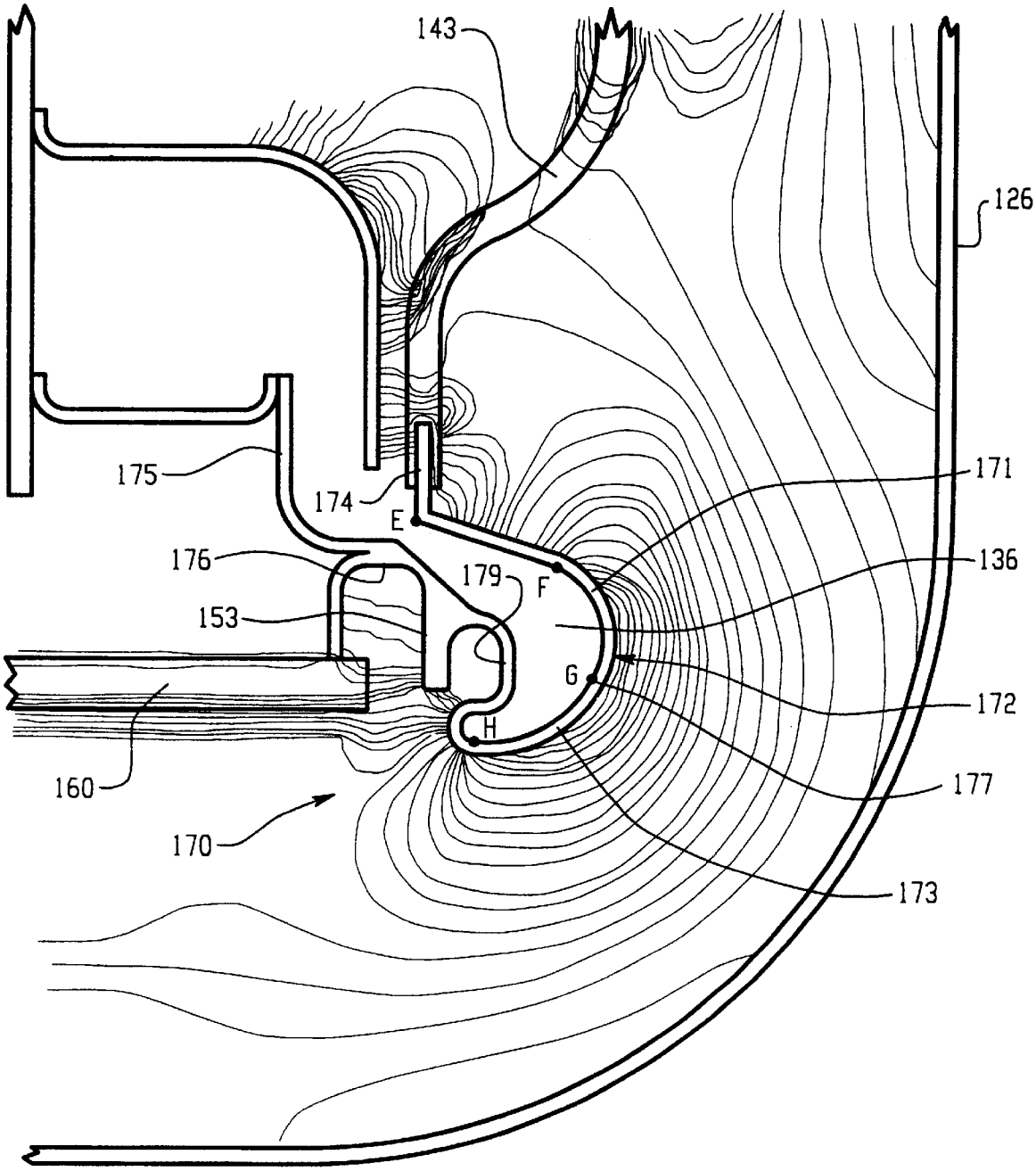
FIG. 9 shows a plot for electric field strength at operating electrical potential for a partial sectional representation of an integral corona shield according to principles of the present invention.

FIG. 9 illustrates another embodiment of a weld member 170 including an integral corona shield 172 according to principles of the present invention. Also shown is a plot for electric field strength at operating electrical potential along the surface of the weld member 170 as well as toward the housing 126. The weld member 170 has as a flange 174 that is joined in a known manner to the glass cathode wall portion 143. The corona shield 172 is a large, smooth rolling compound radius comprised of different curved portions located adjacent to one another along the corona shield 172. Each of the different curved portions having individual radii. In addition, the radii may be different length and/or may have different points of origin. The corona shield 172 begins with a flat portion from point E to point F that extends angularly from the flange 174. A first curved portion 171 having a first radius extends from F to G. A second curved portion 173 having a second radius different than the first radius extends from G to H. Preferably, the first curved portion 171 has a larger radius than the second curved portion 173. It is to be appreciated that more than two radii can be used to form the corona shield 173. A connecting wall 179 extends from H and transitions into a flange 176. The connecting wall 179 may include curved as well as flat portions as shown in FIG. 9. The flange 176 is brazed to the base ring weld flange 153 which is suitably joined to the cathode base plate 160. Optionally, the flange 176 extends to include an getter baffle 175. In addition, as seen in FIG. 9, the corona shield 172 forms part of the wall of the evacuated envelope 135 enclosing the evacuated chamber 136.

At one example of cathode electrical operating potential of approximately −70 kV, the highest electric field strength at the surface of the integral corona shield 172 is approximately $8.55\times10^6$ V/m at a location including the point 177. The electric field strength decreases as a function of distance away from the integral corona shield 165 toward the housing 126. The field strength is relatively constant along a major portion, approximately from F to H and including point 177, of the surface of the corona shield 172. In addition, outside of the relatively constant field strength area, the decrease in field strength is relatively uniform along the corona shield 172. As such, the area of the highest electric field is distributed along a substantial portion of the length of exterior surface of the integral corona shield 172. This consistent level of electric field strength results in a decrease of localized electric field stress risers, thereby reducing the disadvantages discussed above.

Figure 10:
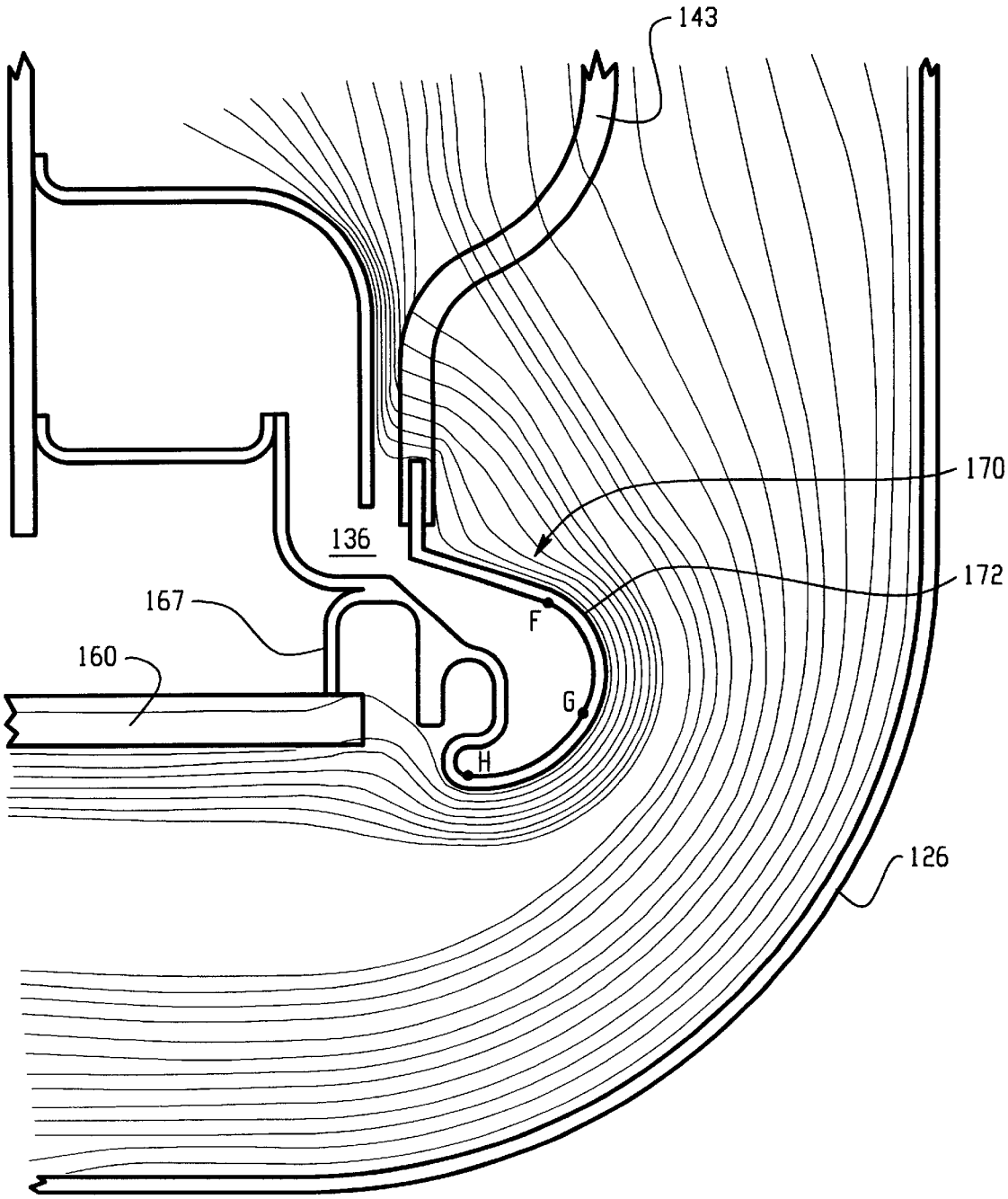
FIG. 10 shows a plot of equipotential lines at operating electrical potential between the corona shield of FIG. 9 and a housing.

Referring to FIG. 10, a plot of equipotential lines for an x-ray tube at operating electrical potential are shown for the integral corona shield 172 of FIG. 9. The equipotential lines between the integral corona shield 172 and the housing 126 generally follow a relatively similar contour of somewhat uniform shape in the region between the corona shield 172 and the housing 126 that results from boundary conditions due to the shape of both the integral corona shield 172 and the housing 126. In this example of a weld member 170, the integral corona shield 172 is shaped so that a major portion of the curved surface of the shield is similar to the contour of the somewhat uniform shape of the equipotential lines between the shield and housing, thereby resulting in the approximate electric field strength profile shown in FIG. 9.

Figure 11:
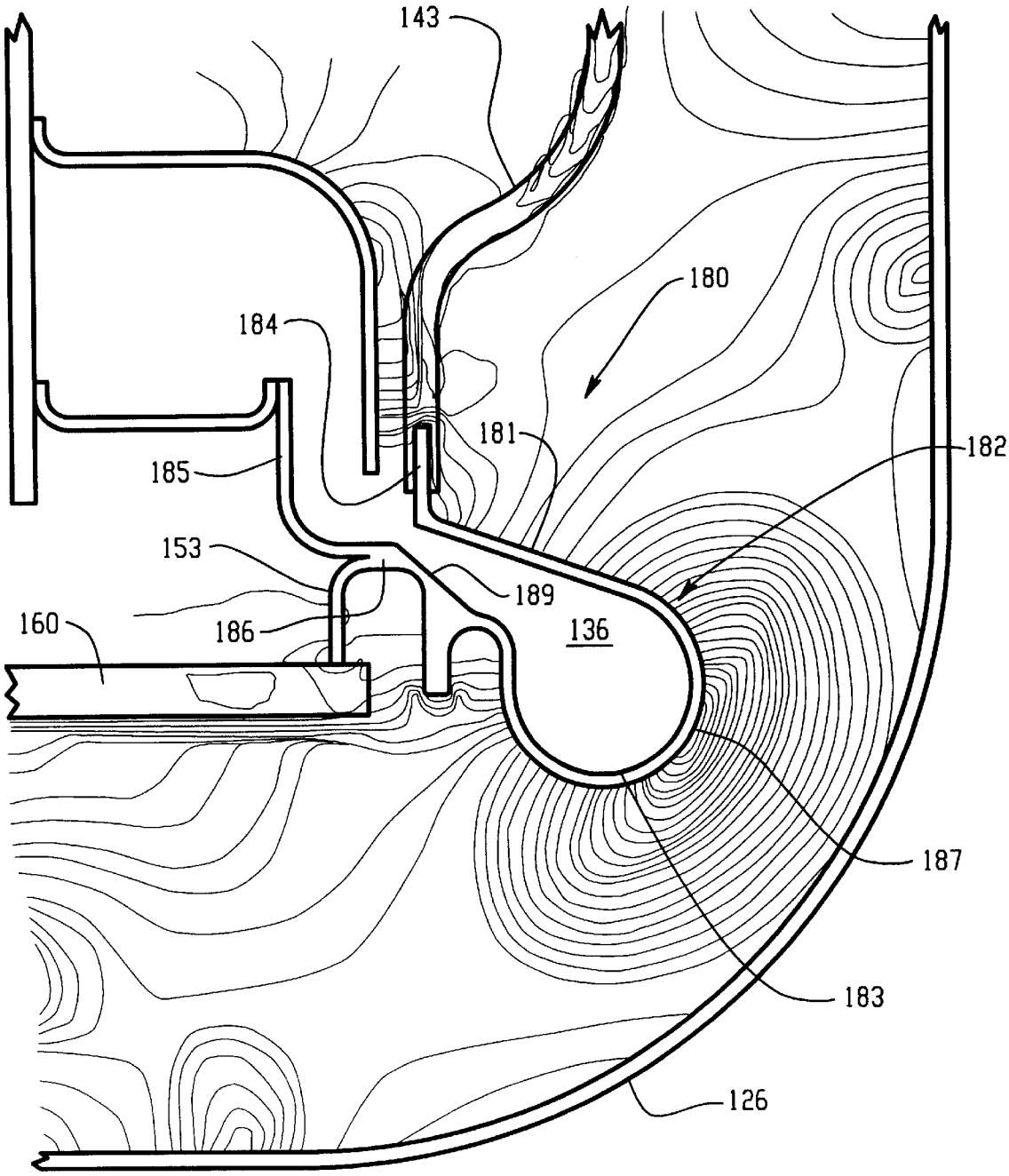
FIG. 11 shows a plot for electric field strength at operating electrical potential for a partial sectional representation of another corona shield configuration according to principles of the present invention.

In FIG. 11, another embodiment is shown of a weld member 180 including an integral corona shield 182 according to principles of the present invention. A plot shows electric field strength at operating electrical potential along the weld member 180 as well as toward the housing 126. The weld member 180 has as a flange 184 that is joined in a known manner to the glass cathode wall portion 143. The corona shield 182 is comprised of a curved shape of a single radius. The corona shield 182 begins with a flat portion 181 that extends angularly from the flange 184 which transitions into a curved portion 183. The curved portion 183 extends around and eventually transitions into a connecting wall 189. The connecting wall blends into a flange 186 that is brazed to the base ring weld flange 153. The base ring weld flange is joined to the cathode base plate 160. Optionally, the flange 186 extends to include a getter baffle 185. The corona shield 182 forms part of the wall of the evacuated envelope 135 enclosing the evacuated chamber 136.

At one example of cathode operating potential of approximately −70 kV, the highest electric field strength along the surface of the integral corona shield 182 is approximately $1.04\times10^7$ V/m for a portion of the shield 182 which includes a location 187. The electric field strength decreases as a function of distance away from the integral corona shield 182 toward the housing 126. In addition, the highest field strength is relatively constant along a substantial portion of the curved surface of the integral corona shield 182. The decrease in field strength outside of the area of highest field strength is relatively uniform along the remaining portion of the curved portion of the corona shield 182. This consistent level of electric field strength results in a decrease of localized electric field stress risers, thereby reducing the disadvantages discussed above.

Figure 12:
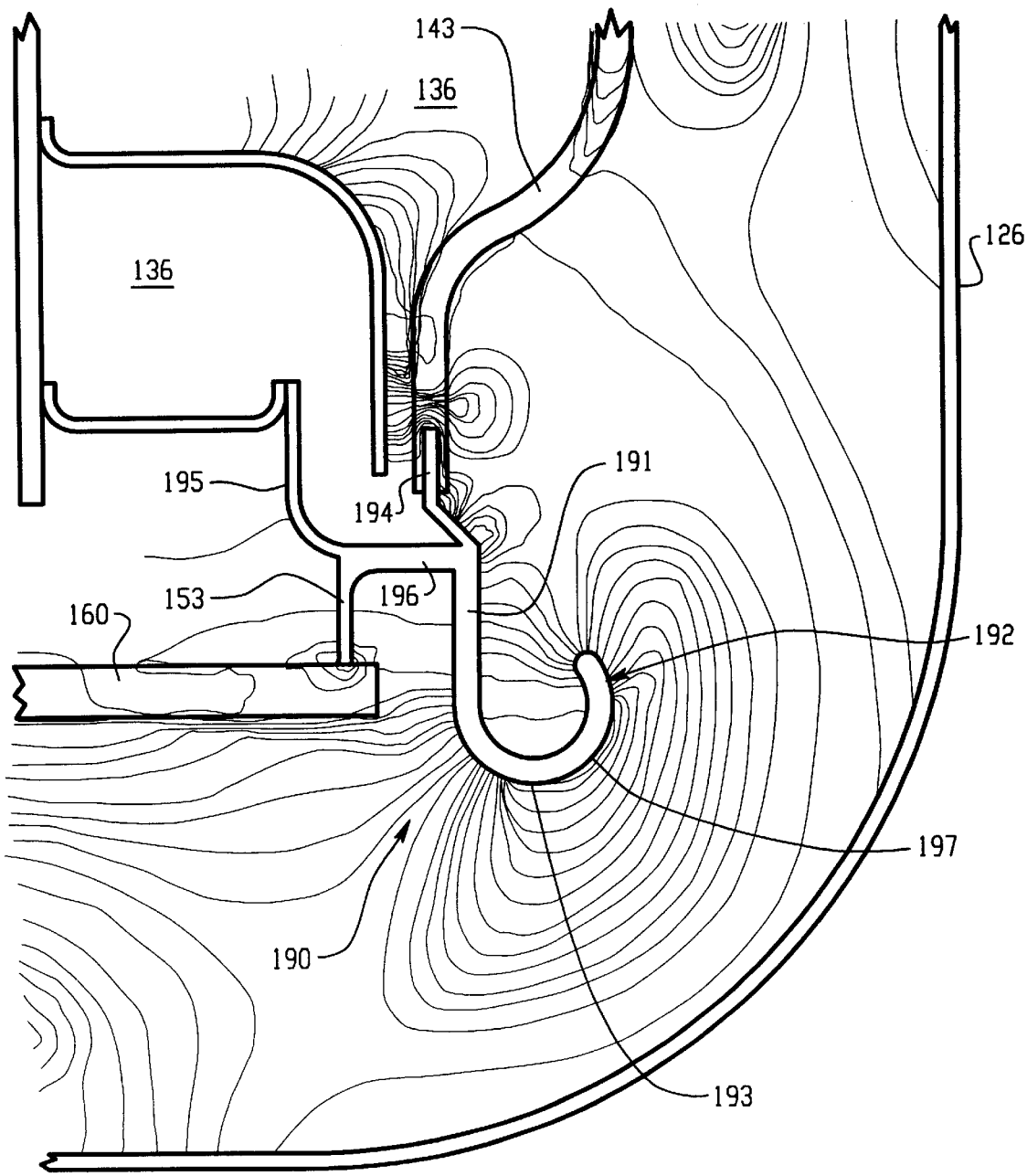
FIG. 12 shows a plot for electric field strength at operating electrical potential for a partial sectional representation of another corona shield configuration according to principles of the present invention.

In FIG. 12 another weld member 190 is shown that includes an integral corona shield 192 that applies principles of the present invention. A plot shows electric field strength at operating electrical potential along the weld member 190 as well as toward the housing 126. The weld member 190 has as a flange 194 that is joined in a known manner to the glass cathode wall portion 143. A second flange 196 extends angularly from the flange 194 toward the central longitudinal axis of the x-ray tube forming a portion of the evacuated envelope 135. The flange 196 is brazed to the base ring weld flange 153 which is suitably joined to the cathode base plate 160. Optionally, the flange 196 extends into the evacuated chamber 136 to include a getter baffle 195.

The integral corona shield 192 is comprised of a curved shape of a single radius. The corona shield 192 begins with a flat portion 191 that extends from the flange 194 in a generally parallel direction with the flange 194. In this embodiment, the corona shield 192 does not form a portion of the evacuated envelope 135. At the end of the flat portion 191, the integral corona shield 192 transitions into a curved portion 193. The curved portion 193 extends in a generally "U" shaped configuration with the open portion of the "U" facing the cathode wall portion 143 as viewed in FIG. 12. The shape of the curved portion of the integral corona shield 193 is a generally large smooth rolling curved surface. Other curved shapes and combinations describing principles of the present invention herein may be used in the integral corona shield.

At one example of cathode operating potential of approximately −70 kV, the highest electric field strength along the surface of the integral corona shield 192 is approximately $1.02\times10^7$ V/m for a portion of the shield 192 which includes a location 197. The electric field strength decreases as a function of distance away from the integral corona shield 192 toward the housing 126. In addition, the highest field strength is relatively constant along a substantial portion of the curved surface of the integral corona shield 192. The decrease in field strength outside of the area of highest field strength is relatively uniform along the remaining portion of the curved portion of the corona shield 192. This consistent level of electric field strength results in a decrease of localized electric field stress risers, thereby reducing the disadvantages discussed above.

Figure 13:
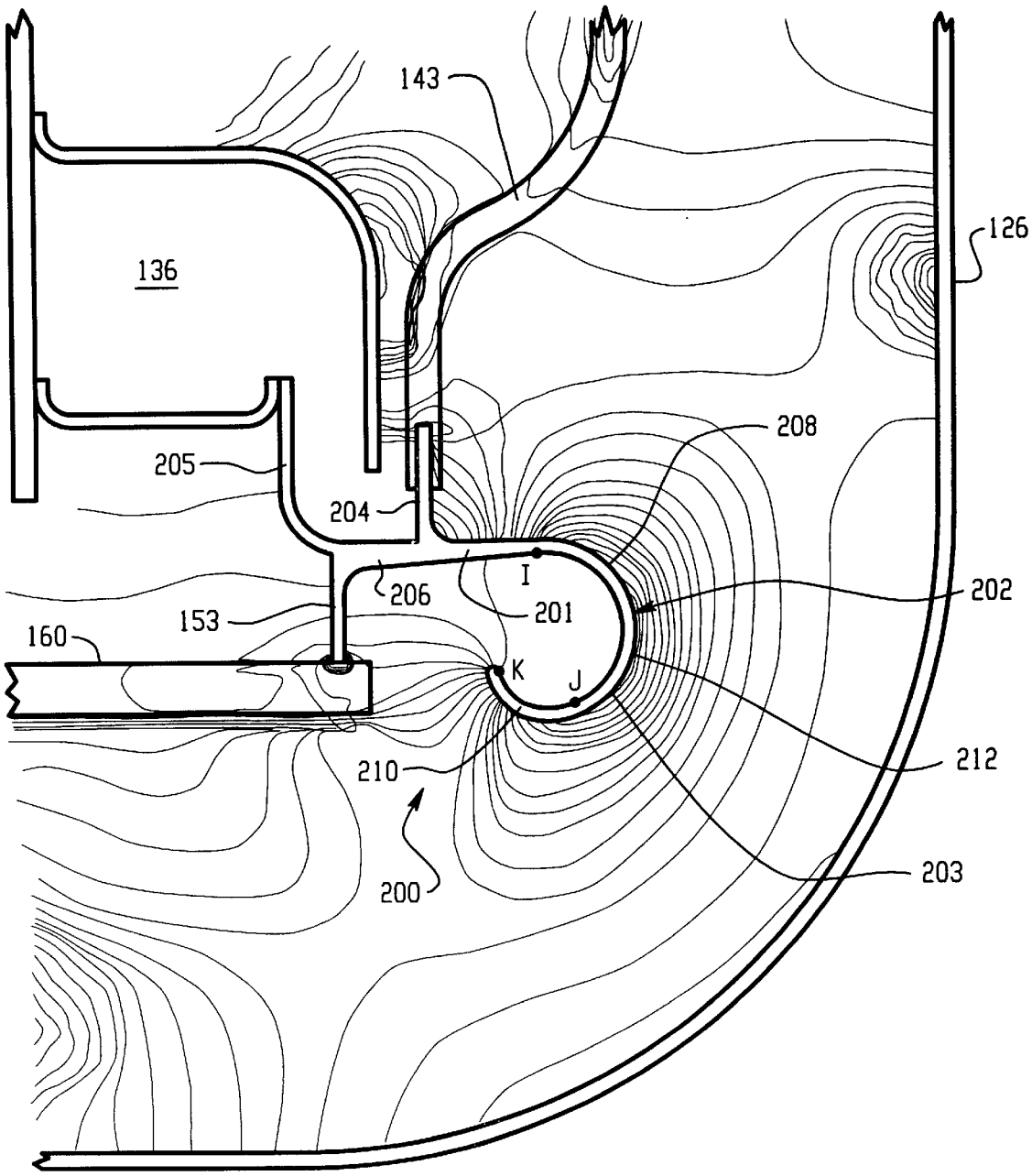
FIG. 13 shows a plot for electric field strength at operating electrical potential for a partial sectional representation of another corona shield configuration according to principles of the present invention.

FIG. 13 shows another weld member 200 that includes an integral corona shield 202 that applies principles of the present invention. A plot shows electric field strength at operating electrical potential along the weld member 200 as well as toward the housing 126. The weld member 200 has as a flange 204 that is joined in a known manner to the glass cathode wall portion 143. A second flange 206 extends angularly from the flange 204 toward the central longitudinal axis of the x-ray tube forming a portion of the evacuated envelope 135. The flange 206 is brazed to the base ring weld flange 153 which is suitably joined to the cathode base plate 160. Optionally, the flange 206 extends into the evacuated chamber to include a getter baffle 205.

The integral corona shield 202 is comprised of a curved shape that is a large, smooth rolling compound radius comprised of different curved portions located adjacent to one another along the corona shield 202. Each of the different curved portions having individual radii. The corona shield 202 begins with a flat portion 201 that extends angularly from the flange 204 toward the housing 126. At the end of the flat portion 201, the integral corona shield 202 transitions into a curved portion 203. The curved portion 203 extends in a generally "U" shaped configuration with the open portion of the "U" facing the cathode base plate as viewed in FIG. 13. The shape of the curved portion of the integral corona shield 203 is a generally large smooth rolling curved surface. A first curved portion 208 having a first radius extends from I to J. A second curved portion 210 having a second radius different than the first radius extends from J to K. Preferably, the first curved portion 208 has a larger radius than the second curved portion 208. It is to be appreciated that more than two radii can be used to form the curved portion 203 of the corona shield 202. In addition, the radii of the different curved sections may be different length and/or may have different points of origin. The integral corona shield 202 does not form a portion of the wall evacuated envelope 135. Other curved shapes and combinations describing principles of the present invention herein may be used in the integral corona shield.

At one example of cathode operating potential of approximately −70 kV, the highest electric field strength along the surface of the integral corona shield 202 is approximately $9.34\times10^6$ V/m for a portion of the shield 202 which includes a location 212. The electric field strength decreases as a function of distance away from the integral corona shield 202 toward the housing 126. In addition, the highest field strength is relatively constant along a substantial portion of the curved surface 203 of the integral corona shield 202. The decrease in field strength outside of the area of highest field strength is relatively uniform along the remaining portion of the curved portion of the corona shield 202. This consistent level of electric field strength results in a decrease of localized electric field stress risers, thereby reducing the disadvantages discussed above.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims.

Having described a preferred embodiment of the invention, the following is claimed:

1. An x-ray tube comprising:

a first electrode;

a second electrode, the first and second electrodes located in operative relationship with one another to generate x-rays when the electrodes are energized at their respective operating potential; and an evacuated envelope enclosing the first and second electrodes, the evacuated envelope including:

a first envelope wall portion;

a second envelope wall portion; and an envelope weld member comprising an electrical conductor, the envelope weld member adapted for vacuum tight joining to the first envelope wall portion and to the second envelope wall portion, the envelope weld member having an integral corona shield portion.

2. The x-ray tube of claim 1 wherein the integral corona shield portion forms a wall portion of the evacuated envelope.

3. The x-ray tube of claim 1 including a getter baffle attached to the weld member, the getter baffle for affecting the dispersion of getter material within the evacuated envelope of the x-ray tube.

4. The x-ray tube of claim 3 wherein the getter baffle is a cylindrical wall having a flared portion at one end, the flared portion joined to the envelope weld member.

5. The x-ray tube of claim 1 wherein the integral corona shield portion of the weld member includes a curved surface.

6. The x-ray tube of claim 5 wherein the curved surface of the corona shield portion includes a radial curve.

7. The x-ray tube of claim 6 wherein the curved surface of the corona shield includes a first curve portion having a first radius and a second curved portion having a second radius different than the first radius.

8. The x-ray tube of claim 7 wherein the first curve portion and second curve portion are adjacent to one another.

9. The x-ray tube of claim 5 wherein the integral corona shield portion comprises:

a flat planar portion;

a sinusoidal curved portion; and a radial curved portion.

10. The x-ray tube of claim 9 wherein the flat planar portion transitions into one end of the sinusoidal curved portion and an opposite end of the sinusoidal curved portion transitions into one end of the radial curved portion.

11. The x-ray tube of claim 1 wherein the first electrode is an anode and the second electrode is a cathode.

12. An x-ray tube comprising:

an anode;

a cathode, the cathode located in operative relationship with the anode to generate x-rays when the anode and cathode are energized at their respective operating potential; and an evacuated envelope enclosing the anode and the cathode, the evacuated envelope including:

a first envelope wall portion;

a second envelope wall portion; and an envelope weld member comprising an electrical conductor, the envelope weld member adapted for vacuum tight joining to the first envelope wall portion and to the second envelope wall portion, the envelope weld member including means to distribute the electric field strength relatively uniformly along the envelope weld member when the x-ray tube is at operating potential.

13. The x-ray tube of claim 12 wherein the means to distribute the electric field strength relatively uniformly along the envelope weld member includes an integral corona shield portion of the envelope weld member.

14. The x-ray tube of claim 13 wherein the integral corona shield portion of the weld member includes a curved surface.

15. The x-ray tube of claim 13 wherein the integral corona shield portion forms a wall portion of the evacuated envelope.

16. The x-ray tube of claim 12 including a getter baffle attached to the envelope weld member to affect distribution of getter material within the evacuated envelope.

* * * * *